US010524501B2

(12) United States Patent
Fujita

(10) Patent No.: US 10,524,501 B2
(45) Date of Patent: Jan. 7, 2020

(54) FILTERS FOR SMOKING ARTICLES HAVING HIGH ADDITIVE(S) LOADINGS

(71) Applicant: JT International S.A., Geneva (CH)

(72) Inventor: Noritoshi Fujita, Luxembourg (LU)

(73) Assignee: JT International S.A. (CH)

( * ) Notice: Subject to any disclaimer, the term of this patent is extended or adjusted under 35 U.S.C. 154(b) by 50 days.

(21) Appl. No.: 15/551,834

(22) PCT Filed: Feb. 18, 2016

(86) PCT No.: PCT/EP2016/053419
§ 371 (c)(1),
(2) Date: Aug. 17, 2017

(87) PCT Pub. No.: WO2016/131901
PCT Pub. Date: Aug. 25, 2016

(65) Prior Publication Data

US 2018/0064162 A1 Mar. 8, 2018

(30) Foreign Application Priority Data

Feb. 18, 2015 (EP) ..... 15155606

(51) Int. Cl.

| | |
|---|---|
| ***A24D 3/14*** | (2006.01) |
| ***A24D 3/02*** | (2006.01) |
| ***A24D 3/16*** | (2006.01) |
| ***A24D 3/10*** | (2006.01) |

(52) U.S. Cl.
CPC ..... *A24D 3/14* (2013.01); *A24D 3/022* (2013.01); *A24D 3/10* (2013.01); *A24D 3/163* (2013.01)

(58) Field of Classification Search
None
See application file for complete search history.

(56) References Cited

U.S. PATENT DOCUMENTS

| | | | | |
|---|---|---|---|---|
| 3,046,996 | A * | 7/1962 | Wright | A24B 15/186 131/309 |
| 2006/0191545 | A1* | 8/2006 | Wolff | A24D 3/08 131/206 |
| 2007/0267033 | A1* | 11/2007 | Mishra | A24B 15/283 131/275 |
| 2008/0011311 | A1* | 1/2008 | Ojima | A24B 15/243 131/332 |
| 2011/0033624 | A1* | 2/2011 | Tsutsumi | A24D 1/025 427/261 |
| 2015/0090282 | A1* | 4/2015 | Lewis | A24D 3/048 131/332 |
| 2015/0374028 | A1* | 12/2015 | Gindrat | G06T 7/0004 700/98 |
| 2016/0219930 | A1* | 8/2016 | Reed | A24D 3/04 |

FOREIGN PATENT DOCUMENTS

| | | | |
|---|---|---|---|
| EP | 1314363 | A1 | 5/2003 |
| WO | 2009080368 | A1 | 7/2009 |
| WO | 2009093051 | A2 | 7/2009 |
| WO | 2013068337 | A1 | 5/2013 |
| WO | 2013164623 | A1 | 11/2013 |
| WO | 2013164624 | A1 | 11/2013 |

OTHER PUBLICATIONS

International Search Report for Application No. PCT/EP2016/053419 dated May 2, 2016.

* cited by examiner

*Primary Examiner* — Eric Yaary
(74) *Attorney, Agent, or Firm* — Lerner, David, Littenberg, Krumholz & Mentlik, LLP

(57) ABSTRACT

The present invention relates to improvements in filters, for use in smoking articles, comprising randomly oriented discrete fibres, wherein a loss of particulate additives can be reduced by adding a liquid with a viscosity of at least 2000 m Pa*s at 20° C. and normal pressure.

13 Claims, No Drawings

FILTERS FOR SMOKING ARTICLES HAVING HIGH ADDITIVE(S) LOADINGS

CROSS-REFERENCE TO RELATED APPLICATIONS

The present application is a national phase entry under 35 U.S.C. § 371 of International Application No. PCT/EP2016/053419, filed Feb. 18, 2016, published in English, which claims priority from European Application No. 15155606.5, filed Feb. 18, 2015, all of which are incorporated herein by reference.

FIELD OF THE INVENTION

The present invention relates to improvements in filters for use in smoking articles, comprising randomly oriented discrete fibres. The improvements mainly relate to the amount of additive(s) that can be loaded on said filters and to the manufacture thereof.

BACKGROUND TO THE INVENTION

In conventional filter cigarettes, the filter commonly consists of a single segment of filtration material, typically a continuous tow of filamentary cellulose acetate plasticised with triacetin, circumscribed by porous and/or non-porous plug wrap. The cellulose acetate is gathered together to form a rod which is cut to form individual filter segments. The filter for a smoking article may be made of one segment of filter rod, or may be made from multiple segments.

In the past it has been proposed to replace the continuous tow with randomly oriented discrete fibres of cellulose acetate. The advantages of using such kind of fibres have been reported and listed in several publications, like WO 2009/080368, WO 2009/093051, WO 2013/068337, WO 2013/164624 and WO 2013/164623. Filter manufacturing machines specifically developed for making such kind of filters are also known, e.g. Turmalin machine made by Hauni Maschinenbau AG, Germany.

With randomly oriented discrete fibres, filters having higher additive loadings can be produced compared to filters using continuous tow. In addition to this, the Turmalin machine is reported as allowing said higher loadings without using any plasticizer such as triacetin, e.g. in WO 2013/164624 and WO 2013/164623.

However, all publications are silent on how to process filters having said higher additive loading. Indeed, the present inventors have found that as soon as filters comprising randomly oriented discrete fibres and high additive loading are cut in order to form individual filter segments or to be assembled in multiple segments filters, a very significant amount of the additive is lost.

Therefore, there is a need to provide filters comprising randomly oriented discrete fibres and a stable, long lasting high additive loading with good performance of the additive, as well as smoking articles with these filters.

SUMMARY OF THE INVENTION

The inventors found that an improvement in additive loss, i.e. decreased loss of at least one particulate additive, can be achieved by adding a liquid with high viscosity to the filter. They further found out that also a reduced pressure loss can be achieved by this addition of the high viscosity liquid.

Thus, a first aspect of the invention provides a filter for a smoking article comprising randomly oriented discrete fibres and at least one particulate additive, wherein said filter further comprises a liquid having a viscosity larger than 2000 mPa·s, preferably equal to or larger than about 2200 mPa·s.

According to another aspect, the present invention relates to a smoking article comprising the filter of the present invention.

Further preferred and exemplary embodiments of the invention are indicated in the dependent claims and the following detailed description, which, however, do not restrict the scope of the invention and only help to understand and explain the features of the present invention. Deviations and modifications on these particular features, particular in regard to other aspects of the invention, can be made without departing from the scope of the invention.

DESCRIPTION OF EMBODIMENTS OF THE INVENTION

All ranges disclosed herein are to be considered to be supplemented by the term "about", unless clearly defined to the contrary or otherwise clear from the context.

All numbers or percentages relating to amounts of a substance within this application are given in wt. %, unless clearly defined to the contrary or otherwise clear from the context.

The term "randomly oriented discrete fibers" refers to a plurality of fibers that can be distinguished from each other and are physically separated, i.e. discrete fibers. They are randomly oriented in three directions, i.e. form a random 3-dimensional fiber network wherein the fibers are directed in any direction, without all fibers being directed in the same direction. The fibers can have different lengths or have the same lengths as well as the same diameter or different diameters, and can be uniform or non-uniform with regard to their individual sizes and shapes.

The term "smoking article" relates to all kinds of smokable products like cigarettes, cigars, cigarillos, etc. In these smoking articles, the kind of smokable material used, e.g. tobacco, tobacco derivatives, expanded tobacco, reconstituted tobacco, tobacco substitutes, non-burnable products, etc., as well as mixtures thereof, is not particularly limited. These smoking articles are provided with a filter according to the invention.

Smoking articles and their formats can be e.g. characterized according to the cigarette length, with "regular" being in the range 68-75 mm, e.g. from about 68 mm to about 72 mm, "short" or "mini" being 68 mm or less, "king-size" being in the range 75-91 mm, e.g. from about 79 mm to about 88 mm, "long" or "super-king" being in the range 91-105 mm, e.g. from about 94 mm to about 101 mm, and "ultra-long" being in the range from about 110 mm to about 121 mm.

They can also be characterized by the circumference of the smoking article, e.g. a cigarette, with "regular" having a circumference of about 23-25 mm, "wide" having a circumference of greater than 25 mm, "slim" having a circumference of about 22-23 mm, "demi-slim" having a circumference of about 19-22 mm, "super-slim" having a circumference of about 16-19 mm, and "micro-slim" having a circumference of less than about 16 mm.

Accordingly, a cigarette in a king-size, super-slim format will, for example, have a length of about 83 mm and a circumference of about 17 mm. Cigarettes in the regular, king-size format have e.g. a circumference of from 23 to 25 mm and an overall length of from 75 to 91 mm.

Each format may be produced with filters of different lengths, smaller filters being generally used in formats of smaller lengths and circumferences. Typically the filter length will be from 15 mm to 30 mm. The tipping paper can have a greater length than the filter, for example from 3 to 10 mm longer.

According to one aspect, the present invention relates to a filter for a smoking article comprising randomly oriented discrete fibres and at least one particulate additive, wherein said filter further comprises a liquid having a viscosity larger than 2000 mPa·s. According to preferred embodiments, the viscosity of the liquid is in the range of from about 2100 to about 5000 mPa·s, preferably from about 2200 to about 4500 mPa·s, further preferably from about 2200 to about 4400 mPa·s. The viscosity of the liquid can e.g. be measured at 20° C. and normal pressure of about 1.01 3 bar using a plate-plate rheometer having a plate size of the stamp of 49.952 mm with integrated Peltier cooling—MCR 101 Anton Paar (Anton Paar GmbH, Austria)—with reference material APN 7.5, APN 100 and APN 1400 (Anton Paar GmbH, Austria) with sample amounts of 3-5 mL, e.g. 4 mL, wherein the sample is applied on the lower fixed plate, the other, flexible plate goes automatically down and starts to twist with a defined shear rate. The result is given in mPa·s. Measurements can be e.g. carried out in duplicate.

According to certain embodiments, the filter of the present invention does not contain a binder or a plasticizer, making processing and manufacturing of the filter easier. A binder may have the disadvantage that it solidifies after application, which leads to contamination in the process and a higher pressure drop. A plasticizer like triacetin can, especially at high loading, lead to melt holes in the filter, i.e. dissolve the filter tow, causing defect in the smoking article. Even without using a binder or a plasticizer, additive loss in the present filter can be reduced using a liquid having a viscosity larger than 2000 mPa·s. Not being bound by a particular theory, it is believed that the liquid having a viscosity larger than 2000 mPa·s achieves a better cohesiveness of the at least one particulate additive, leading to larger particulate additive agglomerates/particles that are less likely to fall out of the filter and further can achieve a reduced pressure drop in the filter, leading to a smoking article that can be easier handled and consumed.

The composition of the liquid is not particularly limited as long as the viscosity of the liquid has the desired value, e.g. as determined at 20° C. and normal pressure. It can consist of one component or comprise two or more components, e.g. also one liquid and one or more compounds that can be dissolved in the liquid, and/or mixtures of two or more liquids. According to certain aspects, the liquid comprises at least glycerine and gellan gum. It can further comprise water. According to certain aspects, the liquid comprises or consists of glycerine, gellan gum and water. In a preferred embodiment, gellan gum is a type of native gellan gum. Native gellan gum is approved to be used in the food industry as edible food additive.

In the filter of the invention, the liquid may further comprise water. In such embodiments, the ratio of glycerine, water and gellan gum is preferably within a range of 70-95.35% glycerine to 29-4.5% water to 1-0.15% gellan gum, further preferably within a range of 80-95% glycerine to 19.25-4.8% water to 0.75-0.2% gellan gum, based on 100 wt. % glycerine, water and gellan gum. More preferably, native gellan gum can be adapted as gellan gum. Native gellan gum is shown in e.g. JP5021101B. The mixture of glycerine, water and gellan gum, preferably native gellan gum, becomes gel-like after mixing. It efficiently provides the solution of this innovation.

The filter of the invention can contain one or more particulate additive(s) which are not particularly limited and are those additives normally used in filters for smoking articles. The additives can be in powder (particle diameter of about 50 to 150 μm) or granular form (particle diameter of 150 to 1000 μm). Examples of suitable particulate additives include flavourants or sorbents—e.g. activated carbon/charcoal, zeolite, ion exchange resin, magnesium silicate like sepiolite, silica gel, alumina, molecular sieves, carbonaceous polymer resins and diatomaceous earths, or combinations thereof. Also, other additives, such as humectants, can be used. According to certain aspects, the particulate additive comprises or is charcoal/activated carbon.

Further, the filtering material may optionally include other material, for example a liquid additive (such as a flavourant, e.g. menthol solution).

In addition, the present filter is also not particularly limited regarding other components of the filter and can include components that are commonly used in filters for smoking articles. For example, the filter may be wrapped with a wrapper or plug wrap, for example a wrapper of paper, e.g. an air-permeable paper. Particulate additives as discussed above can also be applied to the wrapper or plug wrap surrounding the filter material.

According to certain aspects of the invention, the amount of liquid is up to 2.2 mg/mm, preferably up to 2.0 mg/mm, for a regular circumference filter, i.e. a circumference of 23 to 25 mm, e.g. 23, 23.9, 24 or 25 mm. Further, the amount of particulate additive can be up to 18 mg/mm, for a regular circumference filter, i.e. a circumference of 23 to 25 mm, e.g. 23, 23.9, 24 or 25 mm.

The filter tow material, i.e. the material of the randomly oriented discrete fibers, is not particularly limited and can include a material that is typically used in filters for smoking articles, e.g. cigarette filters. It can include natural fiber materials which can be e.g. produced from cellulose, herb materials like tobacco, or synthetic materials like polypropylene. For example, the material of the randomly oriented discrete fibers can comprise or be cellulose acetate or polypropylene. Also mixtures of two or more fiber materials are possible. According to certain aspects, the filter tow type is 6.0Y17000, i.e. a material wherein filament denier is 6.0 g, total denier is 17000 g, and cross-section of fibre is Y shape.

According to certain embodiments, the filter tow weight, i.e. the weight of the fibers only, is greater than 1.7 mg/mm, preferably equal to or greater than 2.0 mg/mm, further preferably about 2.2 to 2.5 mg/mm, for a regular circumference filter, i.e. a circumference of 23 to 25 mm, e.g. 23, 23.9, 24 or 25 mm.

The filter of the invention can have any shape and is not particularly limited, but is preferably in a shape commonly used in smoking articles, e.g. in cylindrical shape. According to certain embodiments, the filter has a cylindrical shape with a circumference of the cylinder being equal to or smaller than 23.9 mm, preferably being equal to or smaller than 16.6 mm. In such embodiments, the volume fraction, i.e. the ratio of volume solid material to total available volume, calculated using material density and weight, of the filter comprising the randomly oriented discrete fibres and the at least one particulate additive material in relation to the total volume of the filter can be from 33% to 51%. This means that the solid material in the filter comprises a volume of 33 to 51% of the available volume in the cylindrical shape of the filter.

The material of the plug wrap is not particularly limited and can comprise paper and/or plastic materials like PE, PP, etc.

According to another aspect, the present invention relates to a smoking article comprising the filter of the present invention. The smoking article is not particularly limited and can be e.g. a cigarette, a cigar or a cigarillo in any size and shape. In such a smoking article, also two or more of the filters according to the invention can be used, or the present filter can be used in combination with another filter. Regarding the further composition, the smoking article of the invention is not limited.

The filter of the present invention may be manufactured by known methods, using common equipment, e.g. a Turmalin machine from Hauni, DE. According to certain embodiments, the liquid having a viscosity larger than 2000 mPa·s is added to filter tow comprising randomly oriented discrete fibers, e.g. cellulose acetate fibers, for example by spraying, and then the loaded filter tow is e.g. cut, at least one particulate additive is added to the filter material, and, then it is formed into e.g. a rod. The cylindrical rod formed to any desired size and shape may be wrapped in a plug wrap and sealed with an adhesive by means that are well-known in the prior art. Afterwards, the filter rod can further be cut into desired lengths using known methods.

EXAMPLES

The present invention will now be described with reference to examples thereof, without limiting the scope of the invention to these particular examples.

In the following, different filters for cigarettes were produced with different liquid materials. The circumference of the filters was 23.9 mm, the filter tow type 6.0Y17000, the filter tow weight: 2.0 mg/mm, the amount of liquid 2 mg/mm, and the liquid position in the center of the filter.

As particulate additive, charcoal (supplier: Jacobi) with an apparent density of 0.46-0.56 g/cc, and an ASTM Mesh size: 30×60 (corresponding to 250-600 μm) was used.

The filter tow (acetate tow; supplier: Celanese) had the following characteristics: Denier per Filament (g/9000 m): 6.00 DNR; Total Denier (g/9000 m): 17,000 DNR; Cross Section: Y. Furthermore, a plug wrap (plug wrap paper; supplier: Delfort) with a porosity ($cm^3/cm^2/min$) of 12,000.00, a basis weight of 25.00 $g/m^2$ and a thickness of 71.00 μm was used in the examples.

In the Examples, the viscosity of the liquid was measured at 20° C. and normal pressure of about 1.013 bar using a plate-plate rheometer having a plate size of the stamp of 49.952 mm with integrated Peltier cooling—MCR 101 Anton Paar—with reference material APN 7.5, APN 100 and APN 1400 with sample amounts of 3-5 mL, e.g. 4 mL, wherein the sample is applied on the lower fixed plate, and the other, flexible plate goes automatically down and starts to twist with a defined shear rate. The result of the measurement was given in mPa·s. Measurements were carried out in duplicate and the mean value taken as viscosity.

First, filter rods were prepared in Example 1 according to the following method:

The filter was manufactured using a Turmalin machine from Hauni, DE. The filter tow bale was processed, cut, metered and defibrated, then the metered charcoal was added. The liquid having high viscosity, described below was added as final liquid during filter making process by spraying at a high temperature of about 100° C. After producing the loaded cellulose acetate tow with additive and liquid, the tow was subjected to base rod making using the plug wrap in a Turmalin machine (Hauni, DE) at a machine speed of 200 m/min, wherein the filter material was wrapped with the plug wrap using Türmerleim SK 1338 (Türmerleim GmbH, DE) and cut to obtain a filter with the desired length of 120 mm.

As liquid, a mixture of glycerine, water and native gellan gum (shown in e.g. JP5021101B) was used as Example 1, titled TGT-01, being a mixture of glycerine, water and native gellan gum in a weight ratio of 82.20% glycerine, 17.30% water and 0.50% native gellan gum, based on the total weight of the three substances, resulting in a liquid with a viscosity of 4352 mPa*s at 20° C. and normal pressure.

The liquid in Example 2, which was otherwise produced as Example 1, was obtained by diluting the liquid TGT-01 with glycerine at a ratio of 50%:50% (weight ratio glycerine: water:native gellan gum=91.10%:8.65%:0.25%), resulting in a liquid titled TGT-02 having a viscosity of 2211 mPa*s at 20° C. and normal pressure.

By diluting the liquid TGT-01 with glycerine at a ratio of 25% TGT-01 and 75% glycerine (weight ratio glycerine: water:native gellan gum=95.55:4.325:0.125), a liquid TGT-03 was obtained having a viscosity of 1953 mPa*s at 20° C. and normal pressure, which was used in Comparative Example 3. Comparative Example 3 otherwise corresponds to Example 1.

As a Comparative Example 1, glycerine was used instead of TGT-01, without addition of native gellan gum, having a viscosity of 1196 mPa*s at 20° C. and normal pressure. The filter was otherwise produced in the same way as in Example 1.

As Comparative Example 2, a filter was produced in the same way as in Example 1 without addition of liquid.

Additive Loss Test:

Filter rods of 120 mm length were weighed and cut into pieces of 6 mm length. Using a Solaris (Combiner; supplier: ITM) at a machine speed of 350 m/min, the filters were again combined, the tip was cut after processing and the combined filters were weighed again at lengths of 120 mm. By determining the weight difference between the filter before and after cutting, the weight lost during cutting can be determined, resulting from the loss of charcoal during cutting. It was observed that the weight loss was substantially attributed to charcoal. A weight loss test without charcoal results in a loss rate of less than 0.7%.

The results of the charcoal loss tests are shown in the following table 1.

TABLE 1

| Example | Liquid | Liquid viscosity at 20° C. | Average charcoal loss [%] (based on total weight of charcoal loaded) |
|---|---|---|---|
| Ex. 1 | TGT-01 | 4352 mPa*s | 14.18 |
| Ex. 2 | TGT-02 | 2236 mPa*s | 14.01 |
| Comp. Ex. 3 | TGT-03 | 1935 mPa*s | 16.08 |
| Comp. Ex. 1 | glycerine | 1196 mPa*s | 17.65 |
| Comp. Ex. 2 | none | — | 16.05 |

As can be seen from Table 1, reduced additive loss can be achieved using the liquid with a viscosity of at least 2000 mPa*s at 20° C. and normal pressure compared to the comparative examples wherein only glycerine was used or no liquid at all.

With the present filters, a reduced additive loss can be achieved in the filter for smoking articles even over a prolonged time, allowing production of reliable smoking products with good and lasting quality.

The invention claimed is:

1. A filter for a smoking article comprising randomly oriented discrete fibres and at least one particulate additive, the particulate additive comprising or being activated carbon, wherein said filter further comprises a liquid having a viscosity larger than 2000 mPa·s, the liquid comprising at least glycerine and gellan gum.

2. The filter according to claim 1, wherein the viscosity of the liquid is in the range of from about 2200 to about 4500 mPa·s.

3. The filter according to claim 1, wherein the amount of liquid is up to 2.0 mg/mm.

4. The filter according to claim 1, wherein the gellan gum is native gellan gum.

5. The filter according to claim 1, wherein the amount of particulate additive is up to 18 mg/mm.

6. The filter according to claim 1, wherein the randomly oriented discrete fibres form a filter tow of type 6.0Y17000.

7. The filter according to claim 1, wherein the randomly oriented discrete fibres form a filter tow having a weight that is greater than 1.7 mg/mm.

8. The filter according to claim 7, wherein the filter tow weight is about 2.2 to 2.5 mg/mm.

9. The filter according to claim 1, wherein the filter has a cylindrical shape with a circumference of the cylinder being equal to or smaller than 23.9 mm.

10. The filter according to claim 9, wherein the volume fraction of the filter comprising the randomly oriented discrete fibres and the at least one particulate additive material in relation to the total volume of the filter is from 33% to 51%.

11. A smoking article comprising a filter according to claim 1.

12. The filter according to claim 4, wherein the liquid further comprises water and a ratio of glycerine, water and native gellan gum is within a range of 70 -95.35% glycerine to 29-4.5% water to 1-0.15% gellan gum, based on 100 wt. % glycerine, water and native gellan gum.

13. The filter according to claim 9, wherein the circumference of the cylinder is equal to or smaller than 16.6 mm.

* * * * *